US009214321B2

(12) United States Patent
Rafferty

(10) Patent No.: US 9,214,321 B2
(45) Date of Patent: Dec. 15, 2015

(54) METHODS AND SYSTEMS FOR APPLYING END CAP DC BIAS IN ION TRAPS

(71) Applicant: 1st Detect Corporation, Austin, TX (US)

(72) Inventor: David Rafferty, Webster, TX (US)

(73) Assignee: 1ST DETECT CORPORATION, Austin, TX (US)

( * ) Notice: Subject to any disclaimer, the term of this patent is extended or adjusted under 35 U.S.C. 154(b) by 0 days.

(21) Appl. No.: 13/794,530

(22) Filed: Mar. 11, 2013

(65) Prior Publication Data

US 2014/0252219 A1 Sep. 11, 2014

(51) Int. Cl.

*H01J 49/42* (2006.01)
*H01J 49/04* (2006.01)
*H01J 49/00* (2006.01)

(52) U.S. Cl.

CPC ..... *H01J 49/0031* (2013.01); *H01J 49/424* (2013.01); *H01J 49/4295* (2013.01)

(58) Field of Classification Search

CPC ..... H01J 49/424
See application file for complete search history.

(56) References Cited

U.S. PATENT DOCUMENTS 4,686,367 A 8/1987 Louris et al.
5,793,038 A 8/1998 Buttrill
6,133,568 A * 10/2000 Weiss et al. ..... 250/292
6,674,067 B2 1/2004 Grosshans et al.
2003/0089846 A1* 5/2003 Cooks et al. ..... 250/281
2003/0150989 A1 8/2003 Yoshinari et al.
2003/0155502 A1* 8/2003 Grosshans et al. ..... 250/282
2004/0211898 A1* 10/2004 Yoshinari et al. ..... 250/292
2004/0232328 A1* 11/2004 Ding et al. ..... 250/292
2005/0279926 A1* 12/2005 Terui et al. ..... 250/287
2009/0146054 A1* 6/2009 Rafferty ..... 250/281
2009/0212209 A1* 8/2009 Quarmby ..... 250/283
2009/0302215 A1* 12/2009 Guna et al. ..... 250/283
2010/0065731 A1* 3/2010 Kawana ..... 250/281
2010/0116982 A1* 5/2010 Iwamoto et al. ..... 250/292
2012/0112056 A1* 5/2012 Brucker et al. ..... 250/282
2014/0264007 A1* 9/2014 Remes et al. ..... 250/282

OTHER PUBLICATIONS

Prentice et al., "Adaptation of a 3-D Quadrupole Ion Trap for Dipolar DC Collisional Activation," *J. Am. Soc. Mass Spectrom.*, 22:1486-1492 (2011).

(Continued)

*Primary Examiner* — Phillip A Johnston
*Assistant Examiner* — James Choi
(74) *Attorney, Agent, or Firm* — Finnegan, Henderson, Farabow, Garrett & Dunner LLP

(57) ABSTRACT

A mass spectrometer for analyzing a sample utilizing an ion trap comprises an entrance end cap defining an entrance aperture configured to receive the sample entering the ion trap; a ring electrode defining a ring cavity configured to generate, based on a radio frequency (RF) voltage applied to the ring electrode, an electric field configured to trap the sample received through the entrance aperture; an exit end cap defining an exit aperture configured to receive sample ions exiting the ion trap; and an end cap controller configured to generate a bias control voltage for applying a DC bias potential to at least one of the entrance end or the exit end cap, wherein a value of the bias control voltage is based on an operational parameter of the mass spectrometer.

17 Claims, 5 Drawing Sheets

(56) References Cited

OTHER PUBLICATIONS

Prentice et al., "DC potentials applied to an end-cap electrode of a 3D ion trap for enhanced $Ms^n$ functionality," *International Journal of Mass Spectrometry*, 306:114-122 (2011).
Prentice et al., "Dipolar DC Collisional Activation in a 'stretched' 3-D Ion Trap: The Effect of Higher Order Fields on rf-Heating," *J. Am. Soc. Mass Spectrom.*, 23:736-744 (2012).
Webb et al., "Implementation of dipolar direct current (DDC) collision-induced dissociation in storage and transmission modes on a quadrupole/time-of-flight tandem mass spectrometer," *Rapid Commun. Mass Spectrom.*, 25:2500-2510 (2011).
International Search Report and Written Opinion in corresponding International Application No. PCT/US2014/019085, 11 pages.

* cited by examiner

METHODS AND SYSTEMS FOR APPLYING END CAP DC BIAS IN ION TRAPS

FIELD OF THE DISCLOSURE

The present disclosure relates generally to methods and systems for operating a mass spectrometer and in particular to applying a DC bias to an ion trap of a mass spectrometer.

BACKGROUND OF THE DISCLOSURE

Mass spectrometers are generally used to determine the distribution of the masses of molecules in a sample material. Some mass spectrometers ionize the molecules, and then determine the mass-to-charge ratio of the ionized molecules by analyzing their dynamic behavior in an electro-magnetic field.

The operation of some mass spectrometers includes a loading phase, during which the spectrometer confines the motion of the ionized molecules to a volume inside, for example, a three dimensional (3D) quadrupole ion trap.

The ion trap may include a number of electrodes. The ion trap receives the ionized molecules and confines them by generating, for example, a dynamic electric field via its electrodes. To generate the field, the mass spectrometer may apply to one or more of its ion trap electrodes a time-varying radio frequency (RF) electric signal.

During the loading phase, the mass spectrometer accumulates ions in the ion trap. Further, during the loading phase, some mass spectrometers slow down and trap ions by causing them to collide with neutral gas molecules that exist in the ion trap. The trapped ions thus move in trajectories, or orbits, confined inside the ion trap. The shape of the trajectory or the frequency of the orbit may vary for different ions.

The operation of some mass spectrometers further includes one or more ejection phases. During each ejection phase, the mass spectrometer ejects some of the captured ions from the ion trap towards a detector. During each ejection phase, the mass spectrometer causes at least some of the captured ions to escape the ion trap. The mass spectrometer may cause such escapes by driving the ions to an unstable dynamic state or by driving them to a resonance state. To create the unstable or resonance state, the mass spectrometer manipulates different characteristics of the field that is confining the ions. In each ejection phase, a subset of the ions may reach the unstable state based on characteristics that include their mass-to-charge ratio.

The detector may output a signal proportional to the number of the ejected ions detected in each ejection phase. The distribution of the number of ejected ions detected in an ejection phase indicates a distribution of the mass-to-charge ratios for different ions in the sample. This distribution may include one or more peaks, each corresponding to a group of ions with approximately the same mass-to-charge ratio.

A mass spectrometer's utility depends on a variety of factors. One factor is the spectrometer's sensitivity. The sensitivity is related to the minimal amount of sample that the spectrometer requires for deriving a spectrum with discernible peaks. The sensitivity of a spectrometer is related to the portion of the sample that the spectrometer is able to utilize for detection. The spectrometer cannot utilize all molecules in the sample, as some of the molecules are lost during the operation. For example, during the loading phase, the spectrometer may not capture all of the ions that enter the ion trap. Instead, some of those ions may exit the ion trap without being confined or may exit at an incorrect time. Similarly, during an ejection phase, the spectrometer may not detect all of the ions that are ejected. Thus, the mass spectrometer's sensitivity can be improved by increasing the capture efficiency; that is, the relative number of ions that the ion trap can capture during the loading phase. Similarly, the mass spectrometer's sensitivity can be improved by increasing the ejection efficiency; that is, the relative number of ejected ions that successfully reach the detector.

Another measure of a mass spectrometer's utility is its resolution. The resolution is related to the ability of the mass spectrometer to produce peaks for a given mass to charge that are distinct from adjacent peaks of a different mass to charge. Such resolution may depend on how fine-tuned the spectrometer is during the ejection phases. A spectrometer might not precisely eject ions of a particular mass-to-charge ratio over a short time period, and may thus show a broadened spectral peak for a single mass-to-charge ratio. A spectrometer may, alternatively, eject together ions that have different but close mass-to-charge ratios, and thus combine peaks that represent separate mass-to-charge ratios into a single broadened peak. The mass spectrometer's resolution, thus, improves if the spectrometer can eject each group of ions with the same mass-to-charge ratio over a short time period and separately from other groups with different values of mass-to-charge ratio.

SUMMARY OF THE DISCLOSURE

A mass spectrometer for analyzing a sample utilizing an ion trap comprises an entrance end cap defining an entrance aperture configured to receive the sample entering the ion trap; a ring electrode defining a ring cavity configured to generate, based on a radio frequency (RF) voltage applied to the ring electrode, an electric field configured to trap the sample received through the entrance aperture; an exit end cap defining an exit aperture configured to receive sample ions exiting the ion trap; and an end cap controller configured to generate a bias control voltage for applying a DC bias potential to at least one of the entrance end or the exit end cap, wherein a value the bias control voltage is determined to increase the utility of the spectrometer.

In some embodiments, the end cap controller adjusts the bias control voltage to compensate for an accumulation of charge on the ion trap electrodes during operation of the mass spectrometer. 3 In some embodiments, the end cap controller adjusts the bias control voltage to compensate for an effect of an asymmetry in the ion trap.

In some embodiments, the end cap controller determines a magnitude of the bias control voltage to compensates for an influence of a hexapolar field on an ability of the electric field of the ring electrode to trap the sample. In some embodiments, the end cap controller is configured to apply electric potentials of same polarity to the entrance end cap and to the exit end cap for generating an end cap quadrupolar excitation, and the end cap controller is further configured to apply a differential DC bias to cause ionized particles of the sample to move towards higher quadrupole excitation areas of the electric field generated by the ring electrode. In some embodiments, the end cap controller applies the DC bias potentials independent of an RF signal applied to the ring electrode, or AC excitation voltages applied to the entrance end cap and exit end cap.

In some embodiments, the end cap controller adjusts the bias control voltage to apply a potential difference between the entrance end cap and exit end cap to reduce a charge density of the sample ions in the ion trap and reduce resulting space charge effects during the operation of the ion trap. In some embodiments, the end cap controller adjusts the bias control voltage to increase the resolution of the mass spectrometer during operation.

A method of operating a mass spectrometer for analyzing sample ions by utilizing an ion trap comprises directing sample molecules through the entrance aperture and into the ion trap; generating, by an end cap controller, a bias control voltage configured to apply an electric potential difference between the entrance end cap and the exit end cap; and adjusting the electric potential difference, via the bias control voltage, to increase the sensitivity or the resolution of the mass spectrometer.

In some embodiments, the bias control voltage is adjusted to compensate for an influence a hexapolar field. In some embodiments, the bias control voltage is adjusted to compensate for an accumulation of surface charge in the ion trap during operation of the mass spectrometer. In some embodiments, the dc bias control voltage is adjusted during an auto-tune phase of operation.

In some embodiments, the dc bias control voltage is adjusted periodically. In some embodiments, the dc bias control voltage is adjusted as a function of a length of operation of the mass spectrometer to compensate for the accumulation of charge in the ion trap. In some embodiments, the dc bias control voltage is adjusted as a function of mass spectrometer performance. In some embodiments, the auto-tune phase of operation is performed when using the spectrometer for a first time.

In some embodiments, the bias control voltage is adjusted to reduce a space charge in the ion trap during its operation. In some embodiments, the end cap controller adjusts the bias control voltage to increase the ability of the ring electrode to trap ionized particles of the sample. In some embodiments, the ion trap is a cylindrical ion trap.

BRIEF DESCRIPTION OF THE DRAWINGS

The drawings are not necessarily to scale or exhaustive. Instead, emphasis is generally placed upon illustrating the principles of the inventions described herein. The accompanying drawings, which are incorporated in and constitute a part of this specification, illustrate several embodiments consistent with the disclosure and together with the description, serve to explain the principles of the disclosure. In the drawings.

DETAILED DESCRIPTION OF THE EMBODIMENTS

Figure 1:
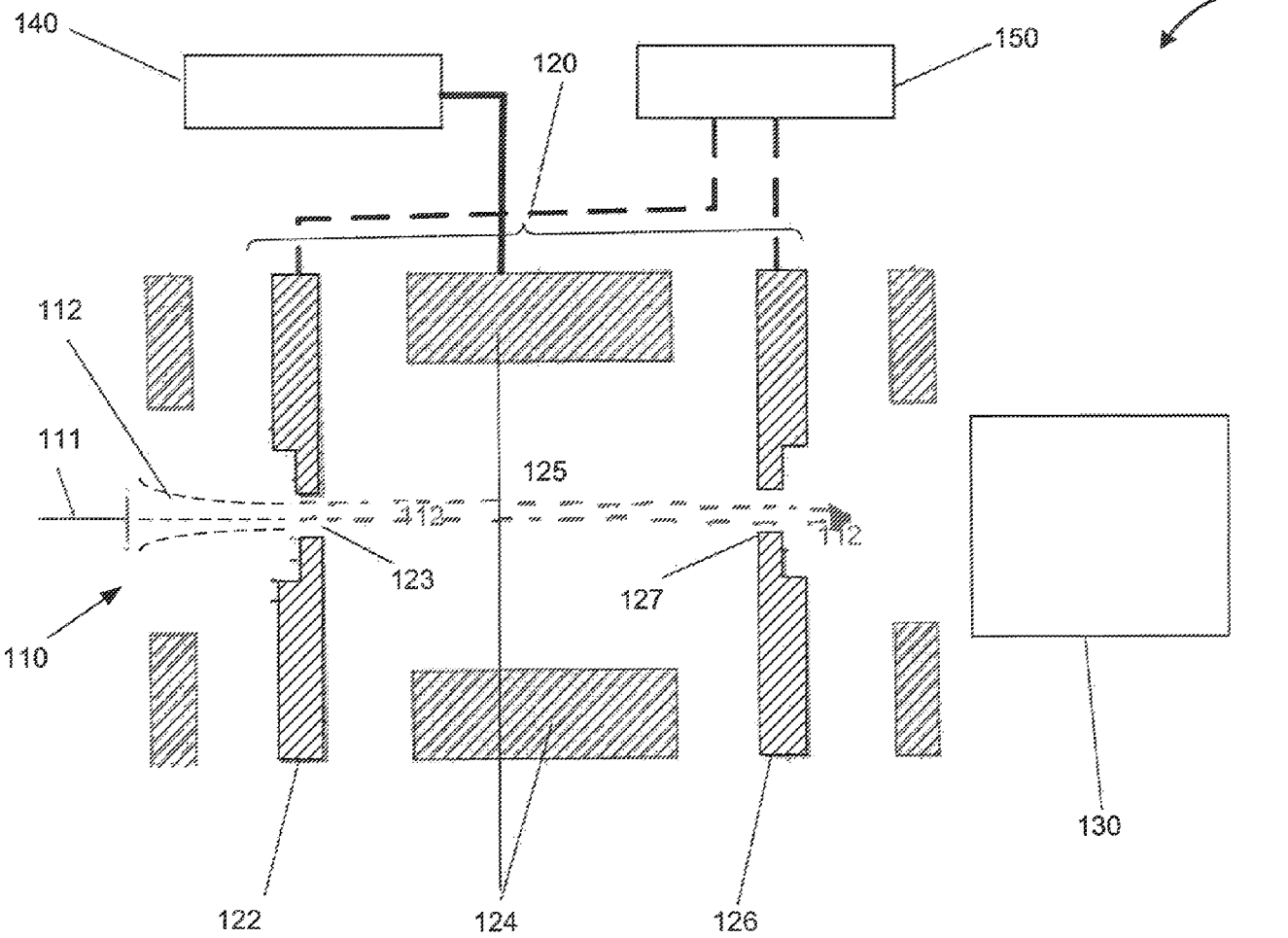
FIG. 1 shows a view of a cross section of an ion trap mass spectrometer according to some embodiments.

The following detailed description refers to the accompanying drawings. Wherever possible, the same reference numbers are used in the drawings and the description to refer to the same or similar parts. Also, similarly-named elements may perform similar functions and may be similarly designed, unless specified otherwise. Numerous details are set forth to provide an understanding of the described embodiments. The embodiments may be practiced without these details. In other instances, well-known methods, procedures, and components have not been described in detail to avoid obscuring the described embodiments. While several exemplary embodiments and features are described here, modifications, adaptations, and other implementations may be possible, without departing from the spirit and scope of the invention. Accordingly, unless stated otherwise, the descriptions relate to one or more embodiments and should not be construed to limit the invention as a whole. Instead, the proper scope of the invention is defined by the appended claims.

Some embodiments increase the accuracy of a mass spectrometer by modifying some parts of the mass spectrometer or by modifying the fields generated by the mass spectrometer during its operation. FIG. 1 shows a view of a cross section of a cylindrical ion trap mass spectrometer 100 according to some embodiments. Mass spectrometer 100 includes an electron generation section 110 and an ion trap section 120, both shown by their cross sections. Ion trap 120 includes an entrance end cap electrode 122, a ring electrode 124, and an exit end cap electrode 126. Mass spectrometer 100 also includes a detector 130, an RF signal generator 140 connected to ring electrode 124, and an end cap controller 150 connected to one or both of end caps 122 and 126.

Some molecules entering the ion trap may be ionized or may be neutral. Further, molecules may be ionized while inside the ion trap. FIG. 1 schematically depicts that during the loading phase, electrons 112 are, emitted from ionizer filament 111 are accelerated by electron optics; and are accelerated and focused towards the ion trap entrance end cap 122, pass through entrance aperture 123 of entrance end cap 122, and enter ring cavity 125 formed inside ring electrode 124 to ionize gaseous molecules in the cavity. Ring cavity 125 is a part of the ion trap cavity defined as the volume surrounded by ring electrode 124, and end caps 122 and 126. For brevity and without causing ambiguity, the ion trap cavity is often referred to as the ion trap. During the ejection phase, some of the captured ions pass through exit aperture 127 of exit end cap 126 and are detected by detector 130.

In some embodiments, the mass spectrometer uses the end cap controller to improve its function, as detailed below. End cap controller 150 applies DC biases to the end caps. End cap controller 150 may generate a monopolar DC field by applying a DC potential to one end cap, or a dipolar DC bias by applying different DC potentials to the two end caps. In some embodiments, as described below in more detail, the end cap controller changes the magnitude or the polarity of the DC bias field at different times or in different phases of operation. In various embodiments, end cap controller 150 includes a variable DC potential source such as a digital to analog converter. In some embodiments, end cap controller 150 also includes adjustment modules for adjusting the magnitude or polarity of the DC bias field. The end cap controller may also generate and apply independent RF signals to each end cap, at selectable frequency, amplitude, or phases. The RF signals may be applied simultaneously with the DC potentials. In various embodiments, a value of the DC bias is determined based on various operational parameters, as detailed below. In some embodiments, the operational parameter includes an amount of usage of the mass spectrometer, a geometry of the spectrometer, an influence of a hexapolar field, or a space charge effect as detailed below.

In various embodiments, during the loading phase, the mass spectrometer dynamically traps within the ion trap some of the ions entering the ion trap. The mass spectrometer may contain these trapped ions using a varying RF quadrupole electric field. In some embodiments, RF signal generator 140 generates the varying RF quadrupole electric field by applying to ring electrode 124 an RF AC electric signal or a combination of an AC signal and a DC electric potential. The mass spectrometer captures the ions by adjusting different characteristics of the applied potentials, such as the magnitude and the frequency of the AC signal. To maintain the ions within the ion trap, the mass spectrometer maintains a combination of those characteristics within a range, called a stability region.

Figure 2:
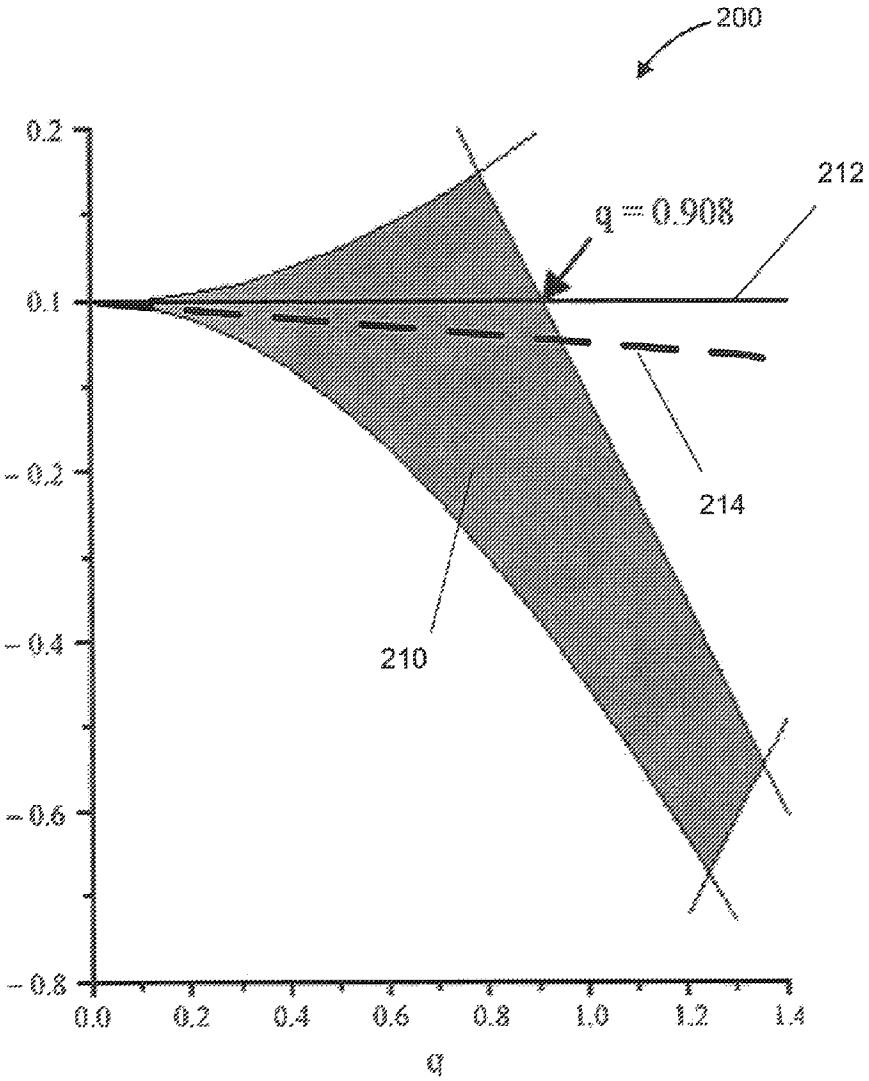
FIG. 2 shows a stability diagram for a quadrupole ion trap according to some embodiments.

FIG. 2 shows a stability diagram 200, which depicts a stability region 210 for a quadrupole ion trap according to some embodiments. Stability diagram 200 shows a two dimensional parameter space defined by a dimensionless stability parameter q in the abscissa and a dimensionless stability parameter a in the ordinate. In some embodiments, the parameter q is proportional to a product of the charge of the ion and the AC component of the ring electrode's electric field, divided by a product of the mass of the ion and the square of the frequency of the AC component of the ring electrode's electric field. The parameter a, on the other hand, is proportional to a product of the charge of an electron and the DC component of the ring electrode's electric field, divided by a product of the mass of the ion and the square of the frequency of the AC component of the signal applied to the ring electrode.

The gray region 210 represents a stability region. That is, when the spectrometer selects the characteristics of the voltages applied to the ion trap electrodes such that stability parameters q and a for an ion fall within stability region 210, the ion's trajectory may remain within the ion trap. If, on the other hand, the spectrometer selects the characteristics such that the parameters q or a for an ion fall outside stability region 210, the ion will become unstable, that is, the ion will leave the ion trap.

A mass spectrometer may trap an ion by changing the stability parameters within the stable region and along the abscissa 212 of diagram 200. That is, the mass spectrometer may set the a parameter to zero and the q parameter below the value of 0.908. The spectrometer may do so by setting the ring electrode's DC field to zero and adjusting the strength or the frequency of the ring electrode's AC field using RF signal generator 140. The spectrometer may change the value of q such that the trajectory of an ion in the parameter space of diagram 200 scans along the abscissa 212. In some embodiments, the trajectory of an ion in the space of diagram 200 is called a scan line. Abscissa 212 up to q=0.908, therefore, reflects a possible scan line for a stable ion.

The mass spectrometer may selectively eject some ions by changing the field characteristics such that the stability parameters for those ions exit the stability region. For example, to eject the ion along scan line 212, the mass spectrometer may change the related parameters such that the q parameter exceeds the value of 0.908. The ejection may occur based on the mass of the ion, because the stability parameter q depends, among other things, on the charge-to-mass ratio. Therefore, under similar conditions for two ions of the same charge, the lighter charge has a larger q.

In some embodiments, after the loading phase, the mass spectrometer increases the mechanical energy of some or all of the captured ions during an ejection phase. The mass spectrometer may do so by changing the characteristics of the ring electrode's electric field to increase q. The mass spectrometer may increase q by, for example, ramping up the amplitude of the RF signal applied to the center electrode. Because q is inversely proportional to the mass, however, heavier ions lag behind lighter ions in their q values. The lighter ions may thus exit the stability region and be ejected before the heavier ions. The ramp up of the RF signal, thus, results in the ejection of lighter ions first.

In some embodiments, during the ejection phase, the mass spectrometer uses mechanisms other than ramping up the RF signal to eject it. For example, the mass spectrometer may excite an ion and eject it while the ion is otherwise well inside its stability region 210. The mass spectrometer may do so by imparting to the ion some additional mechanical energy. In some embodiments, the mass spectrometer excites an ion by resonating the ion at its primary frequency of motion, or secular frequency. The secular frequency of an ion may depend on its mass. Thus, ions with different masses may have different secular frequencies. In various embodiments, the mass spectrometer may apply excitation and ramping up RF field at the same time, or at alternating times. The excitation and ejections phases, may thus overlap, or come in different orders, or repeated more than once.

A mass spectrometer can target ions with a specific secular resonance frequency by adding an alternating field of that frequency to the electric field. In some embodiments, the spectrometer does so by adding a dipolar AC excitation field. Such dipolar AC excitation may be generated by applying to the two end caps, AC potentials that are 180 degrees out of phase. Such a potential difference creates an electric field between the two end caps with alternating polarity. In some embodiments, the spectrometer selects the frequency of the AC excitation field to be the same or near the secular frequency of a targeted set of ions. The AC field will resonate with the targeted ion, adding to its energy and ejecting it from the ion trap. While adjusting values of instability parameter q can eject ions of the same charge in a reverse order of their masses, using the secular resonance of an ion can also eject a heavier ion before a lighter ion.

In some embodiments, the end cap controller excites an ion by applying an alternating quadrupolar excitation signal to the end caps. A quadrupolar excitation signal is generated by applying signals of the same polarity (in phase) to the two end caps simultaneously. A quadrupolar excitation signal is usually applied at a frequency less than the frequency of ring electrode. The end cap controller may excite trapped ion by adjusting the frequency of this end cap quadrupole AC field to the resonance frequency of the targeted ion. In some embodiments, a quadrupolar excitation voltage enhances the resonance ejection of trapped ions by inducing a rapid excitation of the ion, and therefore by generating a higher resolution ejection. This more rapid excitation may occur after the ion starts to experience the quadrupolar excitation field.

However, unlike a dipolar excitation, the quadrupolar excitation field is zero in the center of the trap where most of the trapped ions reside. Therefore, in order to utilize the advantage of a quadrupolar excitation to eject ions, the ions may first be displaced from the center of the ion trap so that they can be acted upon by the quadrupolar excitation field.

In some embodiments, the end cap controller applies a differential DC bias to increase the effect of the end cap quadruple field. Due to its symmetrical shape, the end cap quadruple field may strengthen for points that are further from the center of the ion trap. To increase the effect of end cap quadruple field on the ions, therefore, an end cap controller may apply a differential DC bias between the two end caps in order to move the ions away from the center of the ion trap, that is, to where the ions can be affected by the quadruple excitation, resulting in more rapid ion excitation and therefore more precise ejection and higher spectral resolution.

In various embodiments, the spectrometer's accuracy and sensitivity depends on the scan line. While increasing the parameter q along scan line 212, for example, the spectrometer typically maintains the parameter a at or near zero vale. Near q=0 in stability region 210, the stable range for the a parameter is very narrow, in addition, the separation between sequential mass-to-charge values becomes less and less as q approaches zero. Thus, the value of a at low values of q is critical in order to maximize the stability of masses at the high end of the mass range.

In some embodiments, the mass spectrometer uses the DC bias to apply a scan line other than abscissa 212. Diagram 200 depicts a tilted scan line 214 according to some embodiments. The mass spectrometer generates scan line 214 by applying a DC bias via The end cap controller. In some embodiments, scan line 214 is chosen so that it bisects the stability region near q=0. Such a scan line increases the range of masses that the mass spectrometer can trap. Moreover, as the mass spectrometer increases the q parameter by changing the characteristics of the ring electrode's AC field, it may increase the degree of the DC bias, such that the trajectory of the ion remains on scan line 214 The mass spectrometer might also choose this optimal value of a during the loading phase but may maintain this value of a as q is increased to perform ion ejection.

In some embodiments, the mass spectrometer may use an ion trap that is asymmetric in order to include a hexapole component with the quadrupole trapping field. A hexapole component can be added to an ion trap in a variety of ways, such as using end caps that are different from each other in shape, curvature, or size, or using different spacing from the ring electrode to one end cap than to the other end cap. A hexapole or other odd order fields can benefit ion ejection by causing the ions to be preferentially ejected out of one end cap instead of the other. This increases ion sensitivity when the preferential end cap is the one associated with the ion detector.

Another benefit of including a hexapole field is to improve spectral resolution. A hexapole field component in the trapping field creates positions in the stability diagram with less stability commonly called non-linear resonances. If an ion is excited by an end cap excitation signal at a hexapole non-linear resonance, such as at a beta value of ⅔, then the ion will eject more quickly due to the added instability at the non-linear resonance point. More rapid ion ejection results in better spectral resolution. This effect can be accentuated by use of a differential DC bias across the end caps in order move the ion center of motion away from the center of the ion trap. A differential DC bias may be applied across the end caps of the ion trap during the ejection phase to further reduce the time needed to stimulate the ion to ejection and therefore further improve spectral resolution. Benefits in resolution may be gained by applying a differential DC bias across the end caps in either polarity, but during the ejection phase the differential DC bias polarity may be chosen so as to displace the ions toward the exit end cap. These benefits in resolution may also be gained by applying a differential DC bias across the end caps for ion traps without a hexapole component.

Figure 3:
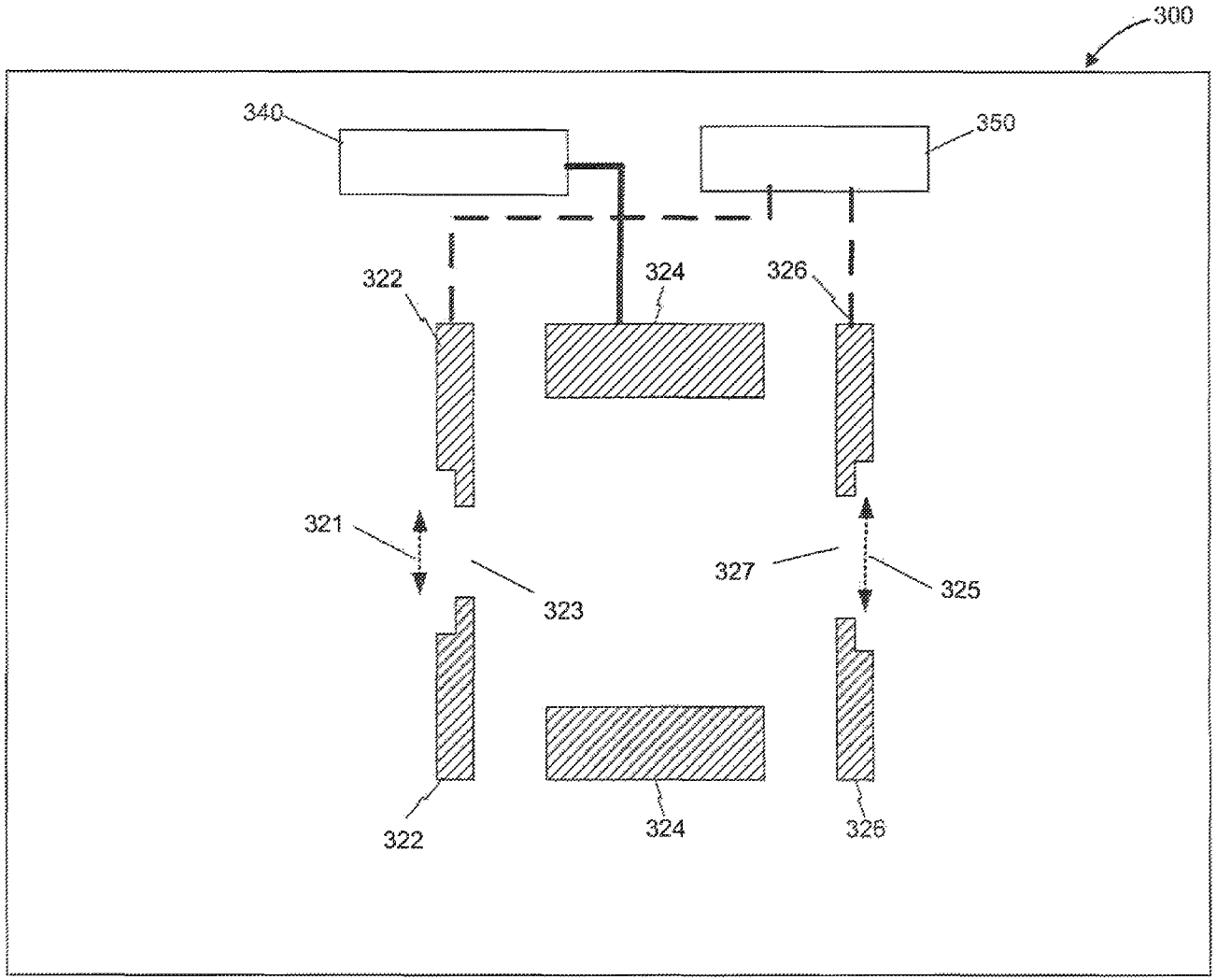
FIG. 3 shows a cross section of an asymmetric ion trap according to some embodiments.

In some embodiments, the hexapole component is added through an asymmetric ion trap. FIG. 3 shows one example of an asymmetric ion trap 300 according to some embodiments. Ion trap 300 includes an entrance end cap 322, a ring electrode 324, an exit end cap 326, a ring signal generator 340, and an end cap controller 350. Entrance end cap 322 defines an entrance aperture 323 with an entrance diameter 321. Exit end cap 326 defines an exit aperture 327 with an exit diameter 325. In some embodiments, entrance aperture 323 or exit aperture 327, or both, are cylindrical channels, and entrance diameter 321 or exit diameter 325 are diameters of those cylinders. In some embodiments, the ion trap is designed such that entrance and exit diameters are not the same. In the embodiment shown in FIG. 3, for example, exit diameter 325 is larger than entrance diameter 321.

Although an ion trap incorporating a hexapole field component can improve spectral resolution, the hexapole field may reduce ion trapping, or capture, efficiency during the loading phase due to lower stability and non-linear resonances. The hexapole field may cause the ion trap to be less stable on the exit end cap side of the ion trap.

In order to overcome a lowered stability of the asymmetric electric field, some embodiments may adjust the differential DC bias across the end caps. In particular, some embodiments apply a differential DC bias field between the end caps in a manner that it opposes the instability effect of the hexapolar field. In some embodiments, the end cap controller controls the polarity and magnitude of the DC bias field by adjusting the magnitude of the electric potential difference between the end caps. The end cap controller may select the polarity and magnitude of the DC bias field such that this field opposes the effect of the hexapolar field during different phases of operation. These phases may include the loading phase as well as an isolation phase or fragmentation phase associated with an $MS^n$ operation, or an ejection phase. The individual DC biases on the end caps may be chosen such that a differential DC bias exists to improve stability, concurrently with an average DC bias value on the end caps of a value which serves to optimize the initial scan line position as noted above.

In some embodiments, the end cap controller also adjusts the DC bias to decrease space charge effects. In various embodiments, trapped ions tend to converge to similar trajectories that are at or near the center of the ion trap. Such accumulation near the center, results in space charge, and causes the ions to interact by electromagnetic interactions. Too many ions in close proximity to each other results in mutual charge repulsion and reduces the performance of the ion trap. Further, the charge accumulation distorts the RF field and may affect the accuracy of ejection phase. Typical effects of space charge include poor resolution as well as mass shifts.

To reduce the space charge, some embodiments apply a DC bias field to spread the charges. In some embodiments, a differential DC bias is applied across the end caps in order to generate a spatial distribution of ions, based on ion mass, along the z axis of the ion trap. The lighter ions may be more stable in the z axis direction and be less affected by the force induced by the differential end cap voltage. As the masses of the ions increase, they may be distributed further away from the center of the trap. In some embodiments, this mechanism is used to reduce space charge for the lighter ions by moving the heavier ions away from the center of the trap. During the ramp up of the ring electrode voltage, the lighter ions may stabilize in their trajectory close to the center of the ion trap. As the lighter ions are ejected, the next heavier ions may move in to take their place as q is increased for all ions. In this way application of differential DC bias across the end caps may increase the usable trapping capacity of the ion trap.

In some embodiments, the mass spectrometer applies a DC bias to compensate for charge build up on different parts of the ion trap. During the operation of the mass spectrometer, the ion trap parts may accumulate deposits or electrically resistive layers. For example, during the ejection phase, some of the ejected ions may not pass through the exit aperture and may instead hit and attach to the internal surface of the exit end cap. Similarly, ions may escape the ion trap and attach to the exit end cap or other parts during loading or excitation phases. Electrically resistive layers may also be produced as a result of electron bombardment, or the result of oxidation. Once a layer of sufficient resistivity is deposited on an ion trap electrode, that layer will be able to support a static charge from ion or electron exposure during the different ion trap operational phases.

The unwanted electric field due to the accumulated charge may disturb different phases of the operation of the mass spectrometer by changing the form of the quadrupole field, or the resonance creating field. In some cases, such build up is termed trap aging. Trap aging, thus, may reduce the efficiency of different phases such as capture or ejection, or even render the spectrometer unusable. For example, trap aging may allow buildup of extraneous charges on the exit end cap. Such extraneous charges create an extraneous electric field pointing from the exit end cap toward the entrance end cap. This extraneous field adds a DC component to the quadrupole field or the resonance generating field, disturbing the pre-set field characteristics for capturing, ramping, or ejecting ions.

In some embodiments, the mass spectrometer generates a DC bias field opposing the extraneous field of trap aging. Moreover, the end cap controller may select the magnitude of the DC bias field such that this field cancels the effect of the extraneous field. In some embodiments, the end cap controller increase the magnitude of the DC bias field in proportion to the duration of usage of the ion trap.

Figure 4:
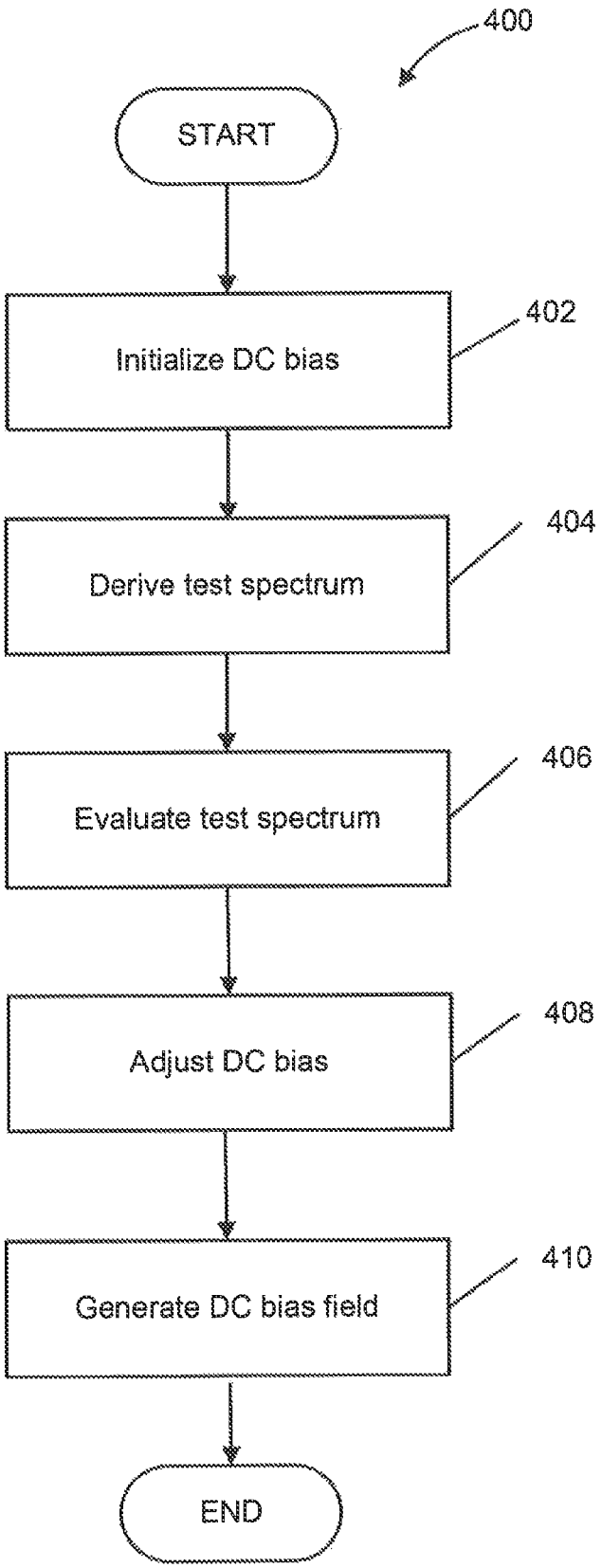
FIG. 4 illustrates a flowchart for an auto-tune operation according to some embodiments.

In some embodiments, the end cap controller periodically adjusts the magnitude or the polarity of the DC bias field. In some embodiments, the end cap controller adjusts these characteristics during an auto-tune phase of the operation. FIG. 4 illustrates a flowchart 400 for an auto-tune operation performed during the auto-tune phase according to some embodiments. One or more steps of flowchart 400 may be executed by an end cap controller. In some embodiments, some of the steps are performed by an operator of the mass spectrometer. The mass spectrometer may periodically perform the auto-tune operation based on a schedule and once every, for example, day, week, or month. The mass spectrometer may also perform the auto-tune operation after a preset number of operations since the last auto-tune. An auto-tune operation may also be initiated, either manually or automatically, in response to a degradation in performance of the mass spectrometer.

In step 402, the spectrometer initializes the DC bias. The spectrometer does so by setting the magnitude or polarity of the DC bias to an initial value. The spectrometer may initialize the DC bias to zero or to its value during the latest operation. As described above, the DC bias voltage signal may be coupled to the end caps to compensate for various effects on the operation of the ion trap.

In step 404, the spectrometer drives a test run to derive a test spectrum based on the initialized DC bias voltage signal generated by the end cap controller. The test run may include operating the spectrometer over a test sample with a known composition. The test sample may include a known amount of a variety of known compositions or materials of interest. During the test run, the spectrometer derives the spectrum of the test sample.

In step 406, the test spectrum is evaluated. Evaluating the test spectrum may include comparing the test spectrum with an acceptable spectrum for the test sample, based on its known composition. The evaluation may include comparing the location, resolution and the magnitude of the peaks in the test spectrum with their expected locations, resolution and magnitudes. In various embodiments, the test spectrum can be evaluated by an operator or by an evaluation software. The evaluation of the test spectrum may indicate that the mass spectrometer is in tune or out of tune, depending on whether the test spectrum does or does not match the expected spectrum of the test sample within some tolerance.

In step 408, the DC bias is adjusted. In some embodiment, the DC bias is adjusted if the spectrometer is out of tune. The DC bias may be adjusted by changing its magnitude or its polarity. In step 410, the adjusted DC bias voltage signal may then be configured to generate a DC bias field between end caps to compensate for certain effects on the operation of the ion trap. In some embodiments, upon adjusting the DC bias, steps 402-410 may be repeated for one or more times to achieve an acceptable test spectrum. In some embodiments, the DC bias is adjusted by an operator via the end cap controller. In some embodiments, the DC bias is adjusted by an automated process executed by the end cap controller. The controller then generates a DC bias voltage signal corresponding to the adjusted DC bias that may be coupled to the end caps.

Figure 5:
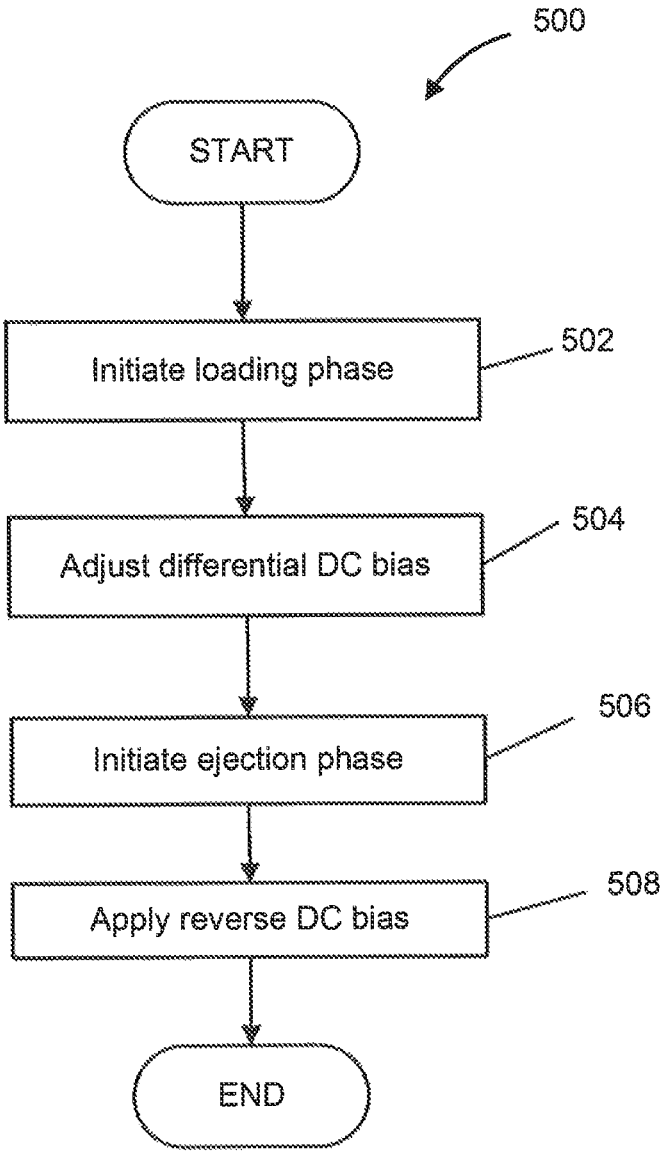
FIG. 5 shows a flowchart for applying DC biases during different phases of operation according to some embodiments.

In some embodiments, the mass spectrometer applies DC biases to increase the capture efficiency and/or the ejection efficiency. FIG. 5 shows a flowchart 500 for such a process according to some embodiments. One or more steps of flowchart 500 may be executed by an end cap controller.

In step 502, the mass spectrometer initiates the loading phase. During the loading phase, the mass spectrometer either receives ions into the ion trap and captures some of those ions in the ion trap, or ionizes and traps molecules within the ion trap.

In step 504, and during the loading phase, the mass spectrometer applies a differential DC bias to increase the loading efficiency according to some embodiments. In particular, the spectrometer may adjust the DC bias to counteract the instabilities introduced by a hexapole filed, which may negatively affect the capture efficiency. In some embodiments, the end cap controller selects the differential DC bias in a manner that optimizes the spectrum of the desired ions. In some embodiments, the end cap controller selects the differential DC bias in a manner that optimizes the test spectrum.

In step 506, the spectrometer enters the ejection phase for one or more types of ions. Upon entering the ejection phase, the mass spectrometer may change the DC bias to increase the ejection efficiency. In various embodiments, the spectrometer may perform the excitation and ejection phases at the same time, in different orders, or repeatedly. In some embodiments, the spectrometer may eject some ions using RF ramp up while ejecting other ions using resonance excitation.

In step 508, during the ejection phase, the end cap controller reverses the polarity of the DC bias in accordance with some embodiments. A reversed differential DC bias may increase the ejection efficiency by pushing the ions closer to the exit end cap and thus increasing the probability of their exit through the end cap aperture. In addition, the differential bias may reduce stability resulting in a quicker and higher resolution ejection, especially at non-linear resonance points. In some embodiments, upon reversing the DC bias, the end cap controller also readjusts the magnitude of the DC bias potential. The polarity and magnitude of the DC bias may be chosen such that it has the optimum effect on ejecting the ions that are targeted for ejection in that ejection phase. In various embodiments, the end cap controller selects the reverse DC bias based on the charge, mass, or energy of the targeted ions. The end cap controller may select the reverse DC bias in a manner that optimizes the spectrum of the targeted ions. The end cap controller may select the reverse DC bias in a manner that optimizes the test spectrum for the targeted ions. In some embodiments, the end cap controller uses different DC biases for different stages of the ejection phase for different targeted ions.

In various embodiments, one or more of the modules disclosed in this disclosure are implemented via one or more computer processors executing software programs for performing the functionality of the corresponding modules. In some embodiments, one or more of the disclosed modules are implemented via one or more hardware modules executing firmware for performing the functionality of the corresponding modules. In various embodiments, one or more of the disclosed modules include storage media for storing data used by the module, or software or firmware programs executed by the module. In various embodiments, one or more of the disclosed modules or disclosed storage media are internal or external to the disclosed systems. In some embodiments, one or more of the disclosed modules or storage media are implemented via a computing "cloud", to which the disclosed system connects via an internet and accordingly uses the external module or storage medium. In some embodiments, the disclosed storage media for storing information include non-transitory computer-readable media, such as a CD-ROM, a computer storage, e.g., a hard disk, or a flash memory. Further, in various embodiments, one or more of the storage media are non-transitory computer-readable media store information or software programs executed by various modules or implementing various methods or flow charts disclosed herein.

The foregoing description of the invention, along with its associated embodiments, has been presented for purposes of illustration only. It is not exhaustive and does not limit the invention to the precise form disclosed. Those skilled in the art will appreciate from the foregoing description that modifications and variations are possible in light of the above teachings or may be acquired from practicing the invention. For example, the steps described need not be performed in the same sequence discussed or with the same degree of separation. Likewise various steps may be omitted, repeated, or combined, as necessary, to achieve the same or similar objectives. Similarly, the systems described need not necessarily include all parts described in the embodiments, and may also include other parts not described in the embodiments. Accordingly, the invention is not limited to the above-described embodiments, but instead is defined by the appended claims in light of their full scope of equivalents.

What is claimed is:

1. A mass spectrometer for analyzing a sample utilizing an ion trap, the mass spectrometer comprising:

an entrance end cap including an entrance aperture configured to receive the sample entering the ion trap;

a ring electrode including a ring cavity configured to generate, based on a radio frequency (RF) voltage applied to the ring electrode, an electric field configured to trap the sample received through the entrance aperture;

an exit end cap including an exit aperture configured to receive sample ions exiting the ion trap; and an end cap controller configured to:

generate a bias control voltage for applying a DC bias potential to at least one of the entrance end cap or the exit end cap to compensate for a trap aging effect resulting from surface charge deposits on the at least one of the entrance end cap or the exit end cap, wherein a value of the DC bias potential is selected to counter an extraneous field created due to the surface charge deposits, wherein the trap aging effect reflects a reduction of efficiency of the ion trap due to an accumulation of surface charge in the ion trap during operation of the mass spectrometer.

2. The mass spectrometer of claim 1, wherein the end cap controller is configured to adjust the bias control voltage based on a geometry of the mass spectrometer to compensate for an effect of an asymmetry in the ion trap.

3. The mass spectrometer of claim 1, wherein the end cap controller is configured to apply a DC bias potential to at least one of the entrance end cap or the exit end cap to compensate for an influence of a hexapolar field on an ability of the electric field within the ion trap to trap the sample.

4. The mass spectrometer of claim 1, wherein:

the end cap controller is configured to apply an AC excitation voltage of the same polarity to the entrance end cap and to the exit end cap for generating an end cap quadrupolar excitation, and the end cap controller is further configured to apply a differential DC bias to cause ionized particles of the sample to move towards higher quadrupole excitation areas of the electric field generated by the ring electrode.

5. The mass spectrometer of claim 1, wherein the end cap controller is configured to apply the DC bias potential independent of the RF voltage applied to the ring electrode, or AC excitation voltages applied to the entrance end cap and the exit end cap.

6. The mass spectrometer of claim 1, wherein the end cap controller is configured to adjust the bias control voltage to apply a potential difference between the entrance end cap and the exit end cap to reduce a charge density of the sample in the ion trap and to reduce a space charge effect during an operation of the ion trap.

7. The mass spectrometer of claim 1, wherein the end cap controller is configured to adjust the bias control voltage to increase a resolution of the mass spectrometer during operation.

8. A method of operating a mass spectrometer for analyzing a sample by utilizing an ion trap, wherein the mass spectrometer comprises an entrance end cap including an entrance aperture, a ring electrode, and an exit end cap including an exit aperture, the method comprising:

directing the sample into the ion trap;

generating, by an end cap controller, a bias control voltage for applying a DC bias potential to at least one of the entrance end cap or the exit end cap to compensate for a trap aging effect resulting from surface charge deposits on the at least one of the entrance end cap or the exit end cap, wherein a value of the DC bias potential is selected to counter an extraneous field created due to the surface charge deposits, wherein the trap aging effect reflects a reduction of efficiency of the ion trap due to an accumulation of surface charge in the ion trap during operation of the mass spectrometer.

9. The method of claim 8, further comprising adjusting the DC bias potential to compensate for an influence of a hexapolar field.

10. The method of claim 8, further comprising adjusting the bias control voltage during an auto-tune phase of operation.

11. The method of claim 8, further comprising adjusting the bias control voltage periodically.

12. The method of claim 8, further comprising adjusting the bias control voltage as a function of a length of operation of the mass spectrometer to compensate for the accumulation of surface charge in the ion trap.

13. The method of claim 8, further comprising adjusting the bias control voltage as a function of mass spectrometer performance.

14. The method of claim 10, wherein the auto-tune phase of operation is performed when using the mass spectrometer for a first time.

15. The method of claim 8, further comprising adjusting the bias control voltage to reduce a space charge effect in the ion trap during operation of the mass spectrometer.

16. The mass spectrometer of claim 1, wherein the end cap controller is configured to adjust the bias control voltage to increase an ability of the ring electrode to trap ionized particles of the sample.

17. The mass spectrometer of claim 1, wherein the ion trap is a cylindrical ion trap.

* * * * *